US009783892B2

(12) United States Patent
Schlosser et al.

(10) Patent No.: US 9,783,892 B2
(45) Date of Patent: Oct. 10, 2017

(54) TRIVALENT CHROMIUM PASSIVATION AND PRETREATMENT COMPOSITION AND METHOD FOR ZINC-CONTAINING METALS

(71) Applicant: Bulk Chemicals, Inc., Reading, PA (US)

(72) Inventors: Ted M. Schlosser, Tamaqua, PA (US); Edward M. Musingo, Royersford, PA (US)

(73) Assignee: Bulk Chemicals, Inc., Reading, PA (US)

( * ) Notice: Subject to any disclaimer, the term of this patent is extended or adjusted under 35 U.S.C. 154(b) by 93 days.

(21) Appl. No.: 14/691,985

(22) Filed: Apr. 21, 2015

(65) Prior Publication Data

US 2015/0322575 A1 Nov. 12, 2015

Related U.S. Application Data

(62) Division of application No. 12/612,362, filed on Nov. 4, 2009, now Pat. No. 9,039,845.

(51) Int. Cl.

| | |
|---|---|
| ***C23C 22/30*** | (2006.01) |
| ***C23C 22/53*** | (2006.01) |
| ***C23C 22/07*** | (2006.01) |
| ***C23C 22/78*** | (2006.01) |
| ***C23C 22/82*** | (2006.01) |

(Continued)

(52) U.S. Cl.

CPC ..... *C23C 22/07* (2013.01); *C23C 22/34* (2013.01); *C23C 22/53* (2013.01); *C23C 22/78* (2013.01); *C23C 22/82* (2013.01); *C23C 2222/10* (2013.01); *C23C 2222/20* (2013.01)

(58) Field of Classification Search

CPC ..... C23C 2222/10

See application file for complete search history.

(56) References Cited

U.S. PATENT DOCUMENTS

| | | | |
|---|---|---|---|
| 4,349,392 | A | 9/1982 | Huvar |
| 4,359,345 | A | 11/1982 | Da Fonte, Jr. |

(Continued)

FOREIGN PATENT DOCUMENTS

| | | | |
|---|---|---|---|
| JP | 2002-332575 | A | 11/2002 |
| WO | WO 2009/112480 | A1 | 9/2009 |

OTHER PUBLICATIONS

U.S. Appl. No. 12/474,960, filed May 29, 2009, Rivera.

International Search Report issued in PCT International Application No. PCT/US2010/055411, dated Feb. 25, 2011.

*Primary Examiner* — Lois Zheng

(74) *Attorney, Agent, or Firm* — Stradley Ronon Stevens & Young, LLP

(57) ABSTRACT

Aqueous compositions useful as pretreatments prior to painting and to prevent the formation of white rust in the uncoated condition include an organopolyphosphonic acid or salt thereof, an organosilane, and a trivalent chromium compound. A method for treating a surface of a zinc-containing metal includes contacting the surface with an aqueous composition including an organopolyphosphonic acid or salt thereof, an organosilane, and a trivalent chromium compound. The composition may also include an agent for reducing hydrophilicity, such as a polyacrylic acid. The aqueous composition has been found to be particularly well-suited for treating a zinc-containing metal to passivate the surface, improve paint adhesion, and/or improve corrosion resistance.

11 Claims, 2 Drawing Sheets

(51) Int. Cl.
*C23C 22/34* (2006.01)
*C23C 22/00* (2006.01)

(56) References Cited

U.S. PATENT DOCUMENTS

| | | | | |
|---|---|---|---|---|
| 4,359,346 | A | 11/1982 | Da Fonte, Jr. | |
| 4,359,348 | A | 11/1982 | Crotty | |
| 4,367,099 | A | 1/1983 | Lash et al. | |
| 4,384,902 | A | 5/1983 | Crotty et al. | |
| 4,578,122 | A | 3/1986 | Crotty | |
| 5,294,266 | A | 3/1994 | Hauffe et al. | |
| 5,393,354 | A | 2/1995 | Bishop | |
| 5,415,702 | A | 5/1995 | Bishop et al. | |
| 6,096,140 | A | 8/2000 | Susa et al. | |
| 6,387,538 | B1 | 5/2002 | Lee et al. | |
| 6,562,474 | B1 | 5/2003 | Yoshimi et al. | |
| 7,018,486 | B2 | 3/2006 | Bhatia | |
| 7,029,541 | B2 | 4/2006 | Diaddario, Jr. et al. | |
| 7,153,348 | B2 | 12/2006 | Izaki et al. | |
| 2009/0280253 | A1 | 11/2009 | Church | |
| 2010/0300891 | A1* | 12/2010 | Rivera | C09D 5/084 205/319 |
| 2011/0008645 | A1 | 1/2011 | Schneider et al. | |

* cited by examiner

TRIVALENT CHROMIUM PASSIVATION AND PRETREATMENT COMPOSITION AND METHOD FOR ZINC-CONTAINING METALS

This application is a divisional of U.S. patent application Ser. No. 12/612,362, filed Nov. 4, 2009, the entire disclosure of which is incorporated herein by reference.

FIELD OF THE INVENTION

This invention relates to compositions and the use of such compositions for passivating and improving the paint adhesion of metal surfaces containing zinc. The invention may be used as a pretreatment prior to painting and is useful to prevent the formation of white rust in the uncoated (unpainted) condition during shipment or construction use, without the use of hexavalent chromium.

BACKGROUND OF THE INVENTION

Hexavalent chromium compounds have been used in traditional conversion coatings to treat metal surfaces to improve their corrosion resistance and paint adhesion. Hexavalent chromium shows toxicological effects and has been determined by the Environmental Protection Agency as a risk to the environment and by the Occupational Safety and Health Agency as a health risk. Moreover, chemistries based on hexavalent chromium are classified as carcinogenic by these agencies.

Within the past few decades, various compositions and processes, not relying on hexavalent chromium, have been described and used for treating metal surfaces. One such example is described in U.S. Pat. No. 7,029,541 to Diaddario, Jr. et al., which describes a composition comprising chromium (III) ions.

SUMMARY OF THE INVENTION

It is highly desirable to provide coatings and processes which are free of hexavalent chromium, but still capable of improving paint adhesion and corrosion resistance of metal surfaces comparable to conventional hexavalent chromium-based coatings. Additionally, there is a need to provide protective coatings having excellent corrosion resistance which prevent white rust formation while maintaining adequate coating weights.

The present invention provides aqueous compositions for treating a zinc-containing metal to passivate the surface, improve paint adhesion, and/or improve corrosion resistance. In one embodiment, the aqueous composition comprises an organopolyphosphonic acid or salt thereof, an organosilane, and a trivalent chromium compound. In another embodiment, the aqueous composition further comprises an agent for reducing hydrophilicity, such as a polyacrylic acid.

In another embodiment, the present invention is a process for treating a surface of a zinc-containing metal. The process includes the step of contacting the metal surface with an aqueous composition comprising an organopolyphosphonic acid or salt thereof, an organosilane, and a trivalent chromium compound.

In another embodiment, the invention is a process for treating a surface of a zinc-containing metal comprising the steps of:

cleaning the metal surface to form a cleaned metal surface;

rinsing the cleaned metal surface with water to form a rinsed metal surface; and contacting the rinsed metal surface with an aqueous composition comprising an organopolyphosphonic acid or salt thereof, an organosilane, and a trivalent chromium compound.

In another embodiment, the process additionally comprises, after the contacting step:

rinsing the metal surface with water; and then painting the surface of the metal.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings. Included in the drawings are the following figures.

DETAILED DESCRIPTION OF THE INVENTION

Figure 1:
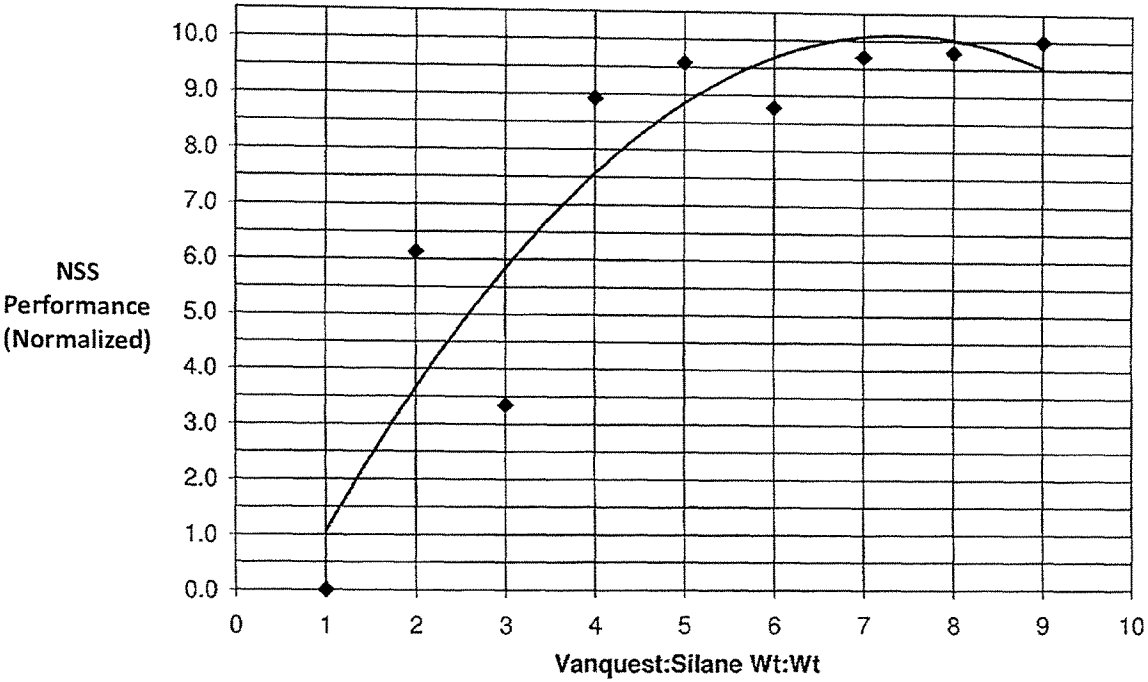
FIG. 1 is a graph presenting the normalized data of Table 3, showing the Neutral Salt Spray performance of various treatment compositions.

The present invention is directed to compositions and processes for treating the surface of a zinc-containing metal. Compositions according to the present invention include an organopolyphosphonic acid or salt thereof, an organosilane, and a trivalent chromium compound. Such compositions may further comprise an agent for reducing the hydrophilicity of the dried coating, such as polyacrylic acid. Processes according to the present invention include cleaning a metal surface, rinsing the metal surface, and contacting the metal surface with a composition including an organopolyphosphonic acid or salt thereof, an organosilane, and a trivalent chromium compound. The processes may further comprise, after the contacting step, the steps of rinsing the metal surface with water and then painting the surface of the metal.

Aqueous compositions of the present invention are used as a passivation treatment and may be used as a pretreatment prior to painting and to prevent the formation of white rust in the uncoated (unpainted) condition. Thus, while the composition is referred to herein as a pretreatment composition for convenience, it is a composition used for pretreatment (i.e., improving the adhesion of subsequently applied paint) and passivation (i.e., resisting corrosion of the unpainted surface). The coating composition results in approximately equal performance to or shows an improvement over conventional passivation coatings which contain hexavalent chromium. "White rust" is defined as white, gelatinous, or waxy deposit that can be observed on metallic surfaces. This deposit is zinc-rich oxide, reportedly of the formula $3Zn(OH)_2.ZnCO_3.H_2O$ and can be quite similar chemically to the protective zinc oxide typically identified as a dull-gray passive oxide. One critical difference between the two oxides is that the white rust oxide is porous and generally non-protective of the substrate, while the passive oxide is dense and non-porous and effectively protects the substrate from exposure to the environment. Galvanizing produces a coating of zinc-iron intermetallic alloy layers on the metal with a relatively pure outer layer of zinc. The zinc coating will oxidize and provide a physical barrier in protecting the bulk of the metal surface from any direct contact with the environment. Post-construction white rust is a problem where the fresh galvanized surface is not able to form a protective basic oxide layer and typically the surface is wetted. In such cases, the deterioration begins when a localized corrosion cell is formed. The activity of such a corrosion cell (or pit) results in rapid penetration through the zinc coating to the metal. Under these corrosive conditions, the surrounding zinc coating may be unable to protect the base metal and consequently the corrosion will continue to penetrate through to the base metal. Corrosion control of a galvanized metal thus depends on forming and maintaining a stable and passive oxide layer.

As used herein, the term "metal," used for example in the phrase "metal surface," includes a wide variety of metals such as aluminum, iron, magnesium, and alloys thereof. Compositions of the present invention are used to treat zinc-containing metals. The term "zinc-containing metals" is a metal which has zinc in an amount greater than 10% (either throughout or in an outer layer) and preferably in an amount less than the content of the primary or named metal. The zinc-containing metals may possess zinc throughout the metal as a monolithic alloy. In addition or as an alternative, the zinc-containing metal may possess zinc as a coating, such that substantially all of the zinc contained by the metal is at the surface of the metal or metal alloy. For example, the zinc-containing metal includes zinc-coated steel, such as galvanized steel.

As used herein, the term "treating" shall mean applying a treatment, or cleaning, rinsing, and applying a pretreatment of the present invention. The pretreatment of the present invention also functions as a sealant to seal the metal surface, so the term "treating" shall optionally include the step of sealing the metal surface. Further, "treating" optionally can include process steps up through and including painting. For example, treatment steps may also include a step of applying a decorative coating, such as painting. After applying the pretreatment of the present invention, the pretreatment may be rinsed first or dried-in-place before application of the paint. Each of these steps above plays a role in a final product's ability to resist corrosion and minimize paint loss, as is well-known in the art. As mentioned above, the treatment composition of the present invention can be used as a pretreatment and is useful to prevent the formation of white rust in the uncoated (unpainted) condition during shipment or construction use, without the use of hexavalent chromium.

As used herein, the term "trivalent chromium compound" means compounds, namely salts, of chromium in which the chromium has a valence of plus 3. No hexavalent chromium (or at most a de minimus, inconsequential amount of it) is present in such compounds. A wide range of anions could be used, and more than one trivalent chromium compound could be used. Chromium nitrate may also be used either along with chromium fluoride or as the sole trivalent chromium compound. The preferred chromium compounds are added to the solution in the form of chromium (III) trifluoride, chromium (III) nitrate, chromium (III) gluconate, and most preferably, chromium fluozirconate.

Exemplary chromium fluozirconate suitable for this purpose are prepared by the methods disclosed by pending U.S. patent application Ser. No. 12/474,960 to Rivera, titled "Method for Making and Using Chromium III Salts" and incorporated by reference herein. This method generally comprises adding hydrogen peroxide to a mixture comprising water and a chromium VI compound in the presence of fluozirconic acid, $H_2ZrF_6$. The resulting $Cr_2(ZrF_6)_3$ composition may contain less than 500 ppm of alkali metal ions and less than 200 ppm of halide ions, relative to chromium and may test negative for chromium VI using s-diphenylcarbazide.

As used herein, the term "organosilane" means a compound having: (1) a silanol or alkoxysilane group (e.g., —Si—$(OH)_n$) or —$Si(OR)_n$); (2) a functional group; and (3) optionally an organic group (such as an alkyl or an aryl group). Such functional groups include, but are not limited to, amino, epoxy, vinyl, and mercapto groups. Without being bound to any theory, it is believed that the organosilane serves to bond with, or assist in bonding among, either the other constituents in the treatment composition or the constituents of other compositions or the metal surface itself or some combination thereof. Exemplary organosilanes which can be used in connection with the present invention include aminopropyltriethoxy silanes, mercapto silanes, and epoxy silanes. Among a variety of silane compounds which will function within the scope of this invention are aminopropyltriethoxy silanes sold under various trade names, including AMEO and Silwet A-1100, and epoxy functional silanes, sold by Momentive Performance Materials under the trademarks MOMENTIVE A-186 and MOMENTIVE A-187. Preferably, the organosilane is a polyalkyleneoxidealkoxysilane, such as that sold by Momentive Performance Materials under the trademark MOMENTIVE A-1230.

As used herein, the term "organopolyphosphonic acid" is meant as an organic compound comprising two or more phosphonic acid moieties per molecule or a salt thereof. Such compounds include bisphosphonic acids and their salts. Preferably, etidronic acid is used, such as the type sold by ClearTech Industries, Inc. under the trademark DEQUEST 2010 or VANQUEST 2010, based on HEDP (1-hydroxyethane-1,1-diphosphonic acid), having the working empirical formula of $C_2H_8O_7P_2$.

A wide variety of organopolyphosphonic acids may be used in the passivation treatment coating composition of the present invention. In one embodiment, the organopolyphosphonic acid is selected from the group consisting of alendronic acid, ibandronic acid, incadronic acid, pamidronic acid, risedronic acid, zoledronic acid, clodronic acid, tiludronic acid, and etidronic acid.

In one exemplary embodiment, a polymethylenephosphonic acid according to formula I may be used $$(HO)_2P(O)CH_2—R^1—CH_2(O)P(OH)_2 \quad \text{I}$$

wherein $R^1$ is a divalent organic radical which may comprise additional phosphonic acid groups and/or other functional substituents.

In another exemplary embodiment, a bisphosphonic acid according to formula II may be used $$H_2PO_3—CR^1R^2—PO_3H_2 \quad \text{II}$$

wherein $R^1$ and $R^2$ are each separately a hydrogen, a hydroxyl group, an alkyl group, an alkylamine, an aryl group, a substituted aryl group, a nitrogen-containing heterocyclic group and/or other functional substituents.

According to an embodiment of the invention, the composition additionally comprises an agent to reduce the hydrophilicity of the coated metal surface. Generally, such agents used to reduce hydrophilicity of the coated metal surface are those that have at least one polymer having a plurality of carboxylic functional groups. As used in the examples, an acrylate such as poly(acrylic) acid can be used as the polymer having a plurality of carboxylic functional groups. Preferably, a polyacrylic acid homopolymer is used, such as the type sold by Rohm and Haas under the trademark ACUMER 1510. Such polyelectrolytes have a carboxylic acid as their ionizable group, which allows them to absorb water. A methylvinylether/maleic acid copolymer, such as the type sold by International Specialty Products under the trademark Gantrez S-97 BF, may serve to reduce hydrophilicity of the coated metal surface. Furthermore, dispersed waxes may be utilized as suitable agents for reducing hydrophilicity of the coated metal surface.

Additional components that are well-known in the art could be included in compositions of the present invention. For example, wetting agents, such as fluorosurfactants, may be included to improve wetting. In some cases, thickeners might also be included if an application requiring a higher viscosity is needed. Finally, if necessary, a compatible biocide, such as a 1,2-benzisothiazolin-3-one biocide sold under the trademark NIPACIDS BIT 20 by Clarion of Charlotte, N.C. or a product sold under the trademark NUOSEPT 495 by ISP Chemicals of Calvert City, Ky., can be included to inhibit biological growth in a working bath.

In an alternative embodiment, the composition of the present invention consists essentially of an organic acid or salt thereof, a trivalent chromium compound, and an organosilane. Such compositions may be used in conjunction with an agent for reducing hydrophilicity, such as a polyacrylic acid, to improve the coverage of the passivation treatment composition on the metal surface. The purpose of such hydrophilicity reducing agents is to reduce the hydrophilicity of the dried coating, which will result in better passivation. Such compositions may also optionally include wetting agents, thickeners, and biocides.

The concentrations of the constituents and the pH of the pretreatment of the present invention, as well as the application temperature and residence time, can vary over a wide range and can be modified in a known manner, depending on the desired coating weight. In addition, the desired coating weight will be a function of the type of metal, the timing of processing after application of the pretreatment, the environmental conditions to which the treated metal is exposed, and the type of decorative coating used, among other factors. For many applications, the coating weight may vary between about 1.0 and about 2.5 mg/ft$^2$ of chromium, as measured by x-ray fluorescence, preferably between about 1.5 and 2.0 mg/ft$^2$.

Component concentrations of a working bath of the present metal pretreatment can vary over a wide range. Appropriate concentration ranges of the various components are primarily dependent upon their solubilities, as is known in the art. Above the solubility limits, the solute may begin to come out of the solution. At concentrations too low, there is insufficient amounts of the constituents to achieve the desired coating weight in a reasonable time and to perform their functions. Further, it has been found that the organopolyphosphonic acid is important for neutral salt spray performance, as test results show that its presence improves the corrosion resistance of the coating. Similarly, the inclusion of silane is important for increasing the performance in Stack Tests and paintability. It is believed that silane serves to bond with, or assist in bonding among, either the other constituents in the pretreatment composition or the constituents of other compositions or the metal surface itself or some combination thereof, thereby improving paint adhesion. In an embodiment of the invention in which the trivalent chromium compound is chromium fluozirconate; the organosilane is a polyalkyleneoxidealkoxysilane; and the organopolyphosphonic acid is etidronic acid, the following ranges in a working bath have been found to be preferred given certain other conditions: 5.00 to 20.00 wt % (55.00 to 220.00 g/L) of chromium fluozirconate (as $Cr_2(ZrF_6)_3$); from 1.00 to 5.00 wt % (11.00 to 55.00 g/L) of polyalkyleneoxidealkoxysilane; and from 3.00 to 10.00 wt % (33.00 to 110.00 g/L) of etidronic acid. More preferably, the ranges are: 7.00 to 15.00 wt % (77.00 to 165.00 g/L) of chromium fluozirconate; from 1.50 to 3.00 wt % (16.50 to 33.00 g/L) of polyalkyleneoxidealkoxysilane; and from 5.00 to 8.00 wt % (55.00 to 88.00 g/L) of etidronic acid. When an additional agent for reducing hydrophilicity is used, such as a compound having at least one polymer having a plurality of carboxylic functional groups, from 1.00 to 10.00 wt % (11.00 to 110.00 g/L), and more preferably, from 2.00 to 5.00 wt % (22.00 to 55.00 g/L) of it may be used.

The compositions given above are of the working bath. It is, of course, desirable to ship the product in the form of a concentrate, namely up to a 10 to 100 fold increase in concentration of the above working bath concentrations.

The pH of the present metal treatments can vary over a wide range, as mentioned above. The pH of the compositions is preferably, when the composition is used to treat a zinc-aluminum alloy, between 1.5 and 5.0, more preferably between 2.0 and 3.5, and most preferably about 3.0. The desired pH may be obtained by adding organopolyphosphonic acid, acetic acid, or nitric acid to reduce the pH, or by adding ammonium carbonate or ammonium hydroxide to increase the pH to the desired value.

Compositions according to the invention may be made by mixing the ingredients in any of a number of sequences. The order of addition of the constituents is not critical. In one embodiment, etidronic acid is added to water, then the organofunctional silane is added to that solution, and finally the chromium compound is added to that solution. This is typically done all as a concentrate, which is diluted at the metal treatment site prior to use to form a working bath. When an additional agent for reducing hydrophilicity is used, such as a compound having at least one polymer having a plurality of carboxylic functional groups, any order can again be used.

In a process of the present invention, a metal surface is coated with a treatment composition of the present invention. In this contacting step, the composition may contact the metal surface by any number of techniques known in the art. One such method is immersion coating in which the metal is immersed in the bath of treatment. Other techniques known in the art including spraying, roll coating, or reverse roll coating, as well as manual application (e.g., brushing). The coating step is done for a time sufficient to achieve the desired coating weight on the metal surface, which can be determined empirically. By using a solution of higher concentration, it is possible to leave this amount of the dried coating with less residence time.

A process for treating a surface of a zinc-containing metal, the process comprising the steps of:

1) cleaning the metal surface to form a cleaned metal surface;

2) rinsing the cleaned metal surface with water to form a rinsed metal surface; and 3) contacting the rinsed metal surface with an aqueous composition comprising an organopolyphosphonic acid or salt thereof, an organosilane, and a trivalent chromium compound.

The process may further comprise, after the contacting step, of the steps of:

4) rinsing the metal surface with water; and 5) then painting the surface of the metal.

The cleaning step may be carried out in any manner known in the art. The types of cleaners suitable for use in the present invention will vary with a number of factors, including the metal being treated, the desired application, and the amount and type of soils on the metal surface. As such, the preferred cleaners can be determined empirically based on these factors. An exemplary alkaline cleaning agent which can be used in connection with the present invention is Bulk Kleen® 842 cleaner, a potassium-based cleaner sold by Bulk Chemicals, Incorporated of Reading, Pa. In general, the cleaning step may be effected by contacting the metal surface with a bath of an alkaline cleaning solution to form a cleaned metal surface. The alkaline cleaning solution may be an aqueous solution of an alkaline cleaning agent. The cleaning bath cleans the metal surface by removing oil and other contaminants from the metal surface. The cleaning bath is effective to remove the loose impurities and surface soils. Thus, the cleaning bath removes certain impurities from the surfaces of the metal surface. If the metal surface is heavily soiled, a detergent cleaner additive may be included in the cleaning step.

A metal surface which has been contacted by an alkaline cleaning solution is referred to herein as a "cleaned metal surface." It is cleaned in the sense it has been exposed to a cleaning bath. It may not be completely cleaned, however, in the sense that substantially all of the impurities have been removed such that it is ready to be exposed to a treatment composition. In some cases, it may be adequately cleaned, but in other cases, it should first be rinsed with water before being contacted with a pretreatment composition (i.e., substantially all of the impurities are, by that point, removed).

The rinsing step is well-known in the art, and deionized water is preferably used. The use of deionized water avoids the introduction of any deleterious ions, such as chloride ions, into the system. The rinsing step can be two-fold, with a first rinsing step done using tap water and then rinsing with deionized water.

After step 2) above, the metal surface may be contacted with the pretreatment composition in a manner that is well known in the art. One such method is immersion coating in which the metal is immersed in the bath of treatment. Other techniques known in the art for applying the pretreatment composition include spraying, roll coating, reverse roll coating, spray or flood squeegee, as well as manual application (e.g., brushing). The contacted metal surface has thus been passivated to minimize the formation of white rust.

After the contacting step, the metal surface may be dried, or rinsed and dried, and then a decorative coating may be applied to it. For example, the metal surface may be painted or lacquered, or first primed then painted. Such steps, priming and painting, are known in the art as "finishing steps," and any known and suitable finishing steps may be used. Suitable paints include acrylic paints and fluorocarbon paints, among others.

As can be inferred, after step 3) above, the metal surface can be dried and then a decorative coating (a paint layer) is applied, without an intervening rinsing step between these steps. This alternative process is known as a "dried-in-place" treatment. Regardless of whether the treatment is "dried-in-place" or there is an intermediate rinsing step, any known method of drying may be employed. The coating may dried by, for example, using an oven, forced air, etc.

As mentioned above, determining the times of treatments of the metal surfaces with the baths of the various steps is well-known in the art. They need only be long enough to permit a sufficient time for cleaning (in the case of the cleaning step) or reaction (in the case of the treatment step). They can be very short or as long as thirty minutes and depend on the stage of treatment, the type of application (e.g., immersion, spray), the type of metal surface, and the desired coating weight, among other factors. The immersion time of a substrate into the composition solution will vary with the stage, and generally varies between approximately 1 second up to about 10 seconds. The times for immersion are typically longer than when spray is used as the method of contact. Rinse times in general can be fairly short, e.g., 3 seconds to one minute. The specific times of treatment may vary over wide ranges and can be readily determined by one of ordinary skill in the art.

The present invention provides an environmentally friendly process for passivating and improving the paint adhesion of metal surfaces containing zinc. The invention may be used as a pretreatment prior to painting and is useful to prevent the formation of white rust in the uncoated (unpainted) condition during shipment or construction use, without the use of hexavalent chromium.

EXAMPLES

The following examples are included to more clearly demonstrate the overall nature of the present invention. Examples 1 and 2 illustrate the improved results obtained by employing aqueous compositions of this invention.

Example 1

A treatment composition comprising distilled water, aminopropyltriethoxy silane, chromium (III) trifluoride and an etidronic acid was prepared and utilized for the testing. A 60% solution of VANQUEST 2010, a proprietary etidronic acid sold by ClearTech Industries, Inc., of Saskatoon, Canada was used for the test compositions. The percent weight additions of the components were varied to test different compositions. A series of no-chrome formulations was also tested to investigate the best ratio between the organics of the treatment composition. Their treatment compositions and comparative formulations are detailed in Tables 1 and 2 below, respectively.

Hot-dip galvanized panels containing 70 g/ft$^2$ zinc were used for testing the compositions. Specifically, 70G unpolished hot-dip galvanized test panels as sold by ACT Test Panel Technologies were used for these tests. Aluminum panels were also used for 5-10% of the test samples.

All of the test panels were cleaned with a potassium-based alkaline preparation (Bulk Kleen™ 842) commonly used to clean metal parts. The alkaline cleaner was prepared at 2% by volume and heated to 140° F. Panels were sprayed for 10 seconds and then rinsed with tap water for 5 seconds. The panels were then dried and divided into groups for application of experimental coatings.

The panels were then flood squeegeed in the following treatment compositions at room temperature, the treatment compositions being:

1. Treatment composition comprising distilled water, aminopropyltriethoxy silane, chromium (III) trifluoride and VANQUEST 2010 etidronic acid at a native pH of about 3;
2. Comparative formulations comprising distilled water, aminopropyltriethoxy silane, and VANQUEST 2010 etidronic acid at a native pH of about 3;

TABLE 1

| Treatment Compositions | | | | | | |
|---|---|---|---|---|---|---|
| Working Composition | Distilled Water | VANQUEST (60% solution) | SILANE | $CrF_3 4H_2O$ | VANQUEST:SILANE (wt:wt ratio) | Neutral Salt Spray (Hrs to Appearance of 5% White Rust) |
| 1 | 74.00% v/v | 13.50% v/v | 9.00% v/v | 3.50% v/v | 9:1 | 360, 432 |
| 2 | 66.50% v/v | 12.00% v/v | 18.00% v/v | 3.50% v/v | 8:2 | 168, 432 |
| 3 | 59.00% v/v | 10.50% v/v | 27.00% v/v | 3.50% v/v | 7:3 | 264, 48 |
| 4 | 51.50% v/v | 9.00% v/v | 36.00% v/v | 3.50% v/v | 6:4 | 72, 96 |
| 5 | 44.00% v/v | 7.50% v/v | 45.00% v/v | 3.50% v/v | 5:5 | 96, 168 |
| 6 | 36.50% v/v | 6.00% v/v | 54.00% v/v | 3.50% v/v | 4:6 | 24, 96 |
| 7 | 29.00% v/v | 4.50% v/v | 63.00% v/v | 3.50% v/v | 3:7 | 24, 24 |
| 8 | 18.50% v/v | 3.00% v/v | 75.00% v/v | 3.50% v/v | 2:8 | 24, 24 |
| 9 | 14.00% v/v | 1.50% v/v | 81.00% v/v | 3.50% v/v | 1:9 | 8, 8 |

TABLE 2

| Comparative Formulations | | | | | |
|---|---|---|---|---|---|
| Working Formulation | Distilled Water | VANQUEST (60% solution) | SILANE | VANQUEST: SILANE (wt:wt ratio) | Neutral Salt Spray (Hrs to Appearance of 5% White Rust) |
| 1 | 77.50% v/v | 13.50% v/v | 9.00% v/v | 9:1 | 2, 4 |
| 2 | 70.00% v/v | 12.00% v/v | 18.00% v/v | 8:2 | 4, 4 |
| 3 | 62.50% v/v | 10.50% v/v | 27.00% v/v | 7:3 | 8, 24 |
| 4 | 55.00% v/v | 9.00% v/v | 36.00% v/v | 6:4 | 24, 24 |
| 5 | 47.50% v/v | 7.50% v/v | 45.00% v/v | 5:5 | 24, 24 |
| 6 | 40.00% v/v | 6.00% v/v | 54.00% v/v | 4:6 | 24, 24 |
| 7 | 32.50% v/v | 4.50% v/v | 63.00% v/v | 3:7 | 24, 24 |
| 8 | 22.00% v/v | 3.00% v/v | 75.00% v/v | 2:8 | 4, 8 |
| 9 | 17.50% v/v | 1.50% v/v | 81.00% v/v | 1:9 | 4, 4 |

The panels were then dried by a hot air drier. The panels were tested using a salt spray (fog) apparatus operated according to ASTM B117-07. It should be noted that a cleaned-only test panel without any treatment was nearly 100% covered with white rust in less than 2 hours. As shown in Table 2 above, comparative formulation 1 (which did not include a trivalent chromium compound) failed the salt spray test at less than or equal to 24 hours. As shown in Table 1 above, compositions of the treatment containing the trivalent chromium compound passed the salt spray test at substantially higher hours. For example, 360 hours under Neutral Salt Spray testing were reached when a 9:1 wt:wt ratio of VANQUEST 2010 to silane was used. Suitable white rust resistance results were also seen by treatment compositions containing 8:2, 7:3, 6:4, and 5:5 wt:wt ratios of VANQUEST 2010 to silane.

TABLE 3

| Neutral Salt Spray Data - Treatment Compositions | | | | | |
|---|---|---|---|---|---|
| Working Composition | VANQUEST: SILANE (wt:wt ratio) | Neutral Salt Spray (Hrs) | Neutral Salt Spray (% White Rust) | Neutral Salt Spray (Hrs) | Neutral Salt Spray (% White Rust) |
| 1 | 9:1 | 360 | 5 | 432 | 0 |
| 2 | 8:2 | 168 | 15 | 432 | 0 |
| 3 | 7:3 | 264 | 5 | 48 | 5 |
| 4 | 6:4 | 72 | 30 | 96 | 5 |
| 5 | 5:5 | 96 | 5 | 168 | 20 |
| 6 | 4:6 | 24 | 5 | 96 | 20 |
| 7 | 3:7 | 24 | 40 | 24 | 20 |
| 8 | 2:8 | 24 | 20 | 24 | 15 |
| 9 | 1:9 | 8 | 15 | 8 | 15 |

TABLE 4

| Neutral Salt Spray Data - Comparative Formulas | | | | | |
|---|---|---|---|---|---|
| Working Formulation | VANQUEST: SILANE (wt:wt ratio) | Neutral Salt Spray (Hrs) | Neutral Salt Spray (% White Rust) | Neutral Salt Spray (Hrs) | Neutral Salt Spray (% White Rust) |
| 1 | 9:1 | 2 | 5 | 8 | 25 |
| 2 | 8:2 | 4 | 10 | 4 | 10 |
| 3 | 7:3 | 24 | 40 | 8 | 10 |
| 4 | 6:4 | 24 | 25 | 24 | 15 |
| 5 | 5:5 | 24 | 15 | 24 | 15 |
| 6 | 4:6 | 24 | 55 | 24 | 30 |
| 7 | 3:7 | 24 | 55 | 24 | 20 |
| 8 | 2:8 | 4 | 10 | 8 | 5 |
| 9 | 1:9 | 4 | 10 | 4 | 10 |

Figure 2:
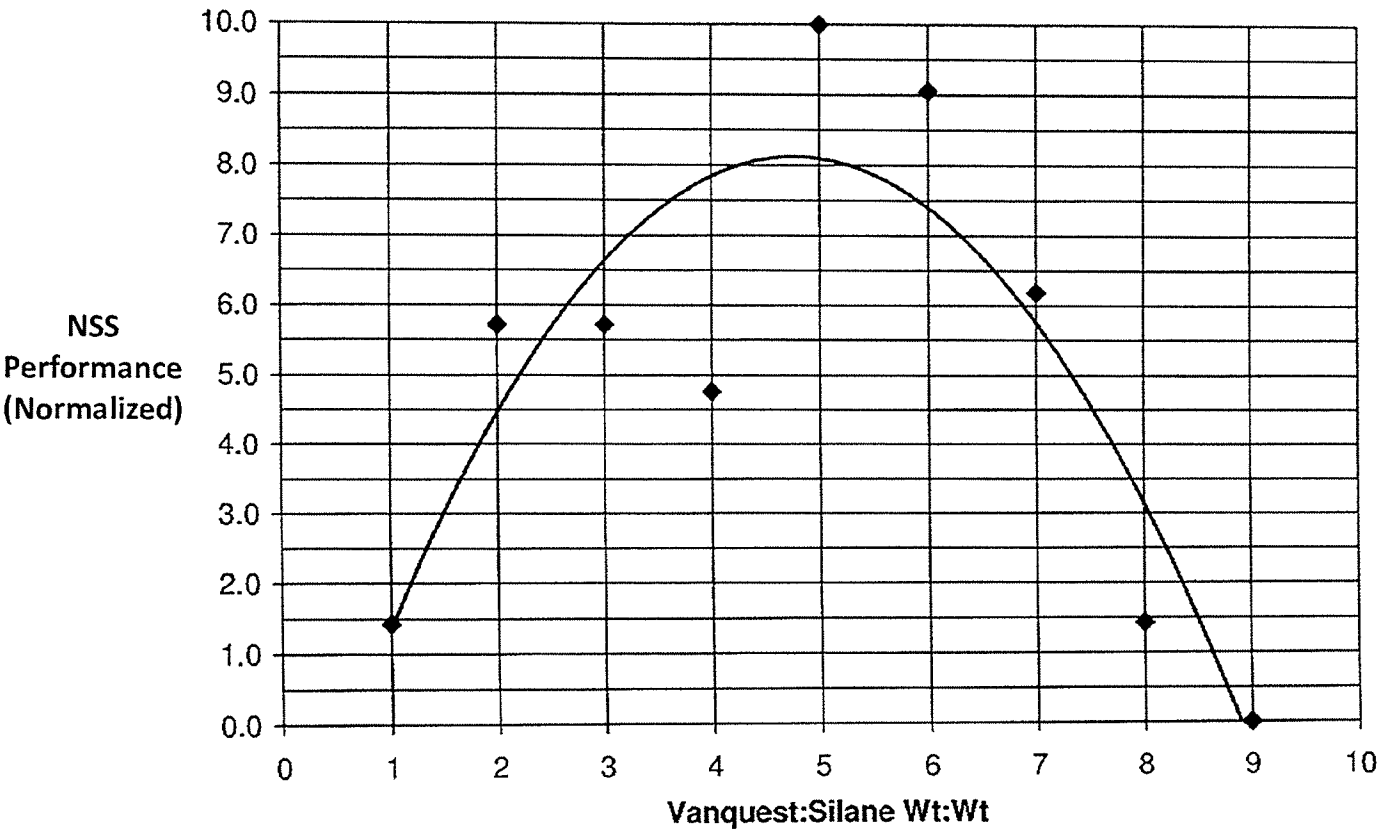
FIG. 2 is a graph presenting the normalized data of Table 4, showing the Neutral Salt Spray performance of various comparative formulas.

Table 3, above, shows that various treatment compositions passed white rust resistance via a salt spray test at times ranging from 72 hours to 432 hours. FIG. 1 and FIG. 2 graphically present the data in Table 3 and Table 4, respectively. As can be seen from comparing the graphs on FIGS. 1 and 2, various working compositions of the present invention performed significantly better under Neutral Salt Spray testing, for resistance to white rust, than the comparative formulations which did not contain a trivalent chromium compound. The comparative formulations without the trivalent chromium compound were used to investigate the best ratio between the organics (organosilane and organo-polyphosphonic etidronic acid). A weight-weight ratio range for the organics was tested, and an optimum ratio of 1:1.126 VANQUEST to silane was identified.

The results show that formulations of the treatment compositions containing trivalent chromium compounds showed excellent corrosion resistance and prevented the formation of white rust in the uncoated (unpainted) condition after salt spray testing.

Example 2

Another series of experiments was performed to investigate the performance of various treatment compositions according to the invention in preventing corrosion on unpainted hot-dip galvanized (HDG) substrates. The composition formulas utilized chromium fluozirconate as the chromium compound and VANQUEST 2010 etidronic acid as the organopolyphosphonic acid, but varied the organosilane used. The composition formulas additionally and optionally varied the use of an agent for reducing the hydrophilicity of the coated metal surface. ACT 4"×6" G70 hot-dipped galvanized panels, available from ACT Laboratories of Hillsdale, Mich., were used as the metal surface for these experiments and cleaned using the same methods in the experiments described previously above.

The evaluation of the passivation and pretreatment of galvanized metal was made through a series of tests known to one skilled in the art. The HDG panels were tested under neutral salt spray ("NSS") exposure conditions in accordance with ASTM B-117-07. Results are represented generally as testing hours in NSS without the appearance of corrosion products. The panels were also tested under "Stack Testing" to measure the tendency for white rust or discoloration to develop on wet packed metal surfaces. Treated panels were subjected to a stack test which was conducted by misting each side of a panel with a fine mist of deionized water and placing another identical panel on top of the misted panel, with the treated surfaces face-to-face. Various treatment compositions were used to each treat a pair of panels, and the process repeated until a stack of panels was obtained. Non-tested panels commonly referred to as "waster panels" were placed on each end of the panel stack. The stack of panels was placed under a 5 pound weight and allowed to sit in a 100% relative humidity cabinet at 100° F., as described by ASTM D-2247-02. At 96 hours, all of the panels in a given stack were evaluated for percent white rust corrosion on the surface. Additional treatment compositions were tested in the manner described above for 360 hours. Evaluations were conducted at the end of the stack test periods to assess the percentage of the treated test panel surface covered by white rust. Under Stack Testing, an assessment of 0% rust means that no amount of the treated surface showed rust within the given time frame.

A condensing test known as "QCT Testing" was also used to evaluate the passivation and pretreatment of galvanized metal panels. In the QCT test, the panels were exposed for 20 days (480 hours) in a Controlled Condensation Apparatus as described by ASTM D-4585-07, such as the Cleveland Condensing Type Humidity Cabinet sold by the Q-Panel Company of Cleveland, Ohio. The treated fronts of the panels are subjected to a water bath vapor at 140° F. while the backs of the panels are at room temperature. This enables effective condensation on the panels and tests the treated panels' ability to resist corrosion and rusting. The treated panels were evaluated daily to check for signs of corrosion or rusting. Under QCT Testing, the hour when corrosion or rusting is first observed is recorded as a measure of the treatment's performance.

The results of the various compositions of the present invention, evaluated by the tests described above, are summarized below in Table 5. The compositions varied in their ingredients and/or by the ratio of inorganic ingredients to organic ingredients. The organics ingredients were mostly an organofunctional silane and an organopolyphosphonic etidronic acid, but also included a polyacrylic acid or other agent for reducing hydrophilicity of the coated metal surface in some formulas. Additionally, the stability of the various compositions of the present invention was assessed as a measure of precipitation in the undisturbed compositions over a period of time.

All of the test panels were again cleaned with a potassium-based alkaline preparation (Bulk Kleen™ 842) commonly used to clean metal parts, using the procedures described in Example 1. After drying, the panels were then immersed in the following treatment compositions at 95° F. for 2 minutes, the treatment compositions being:

1. Treatment composition comprising 68.54 wt % distilled water, 5.1 wt % Silquest-A1100 aminopropyltriethoxy silane, 7.0 wt % chromium fluozirconate, 10.9 wt % ACUMER 1510 polyacrylic acid, and 10.7 wt % VANQUEST 2010 etidronic acid; in which the inorganic to organic ratio of the composition was 0.40.

2. Treatment composition comprising 62.2 wt % distilled water, 6.3 wt % Silquest-A1100 aminopropyltriethoxy silane, 5.9 wt % chromium fluozirconate, 13.4 wt % ACUMER 1510 polyacrylic acid, and 13.2 wt % VANQUEST 2010 etidronic acid; in which the inorganic to organic ratio of the composition was 0.58.

3. Treatment composition comprising 72.64 wt % distilled water, 1.0 wt % MOMENTIVE A186 epoxy silane, 7.0 wt % chromium fluozirconate, 10.9 wt % ACUMER 1510 polyacrylic acid, and 10.7 wt % VANQUEST 2010 etidronic acid; in which the inorganic to organic ratio of the composition was 0.48.

4. Treatment composition comprising 71.64 wt % distilled water, 2.0 wt % MOMENTIVE A186 epoxy silane, 7.0 wt % chromium fluozirconate, 10.9 wt % ACUMER 1510 polyacrylic acid, and 10.7 wt % VANQUEST 2010 etidronic acid; in which the inorganic to organic ratio of the composition was 0.45.

5. Treatment composition comprising 76.0 wt % distilled water, 6.3 wt % MOMENTIVE A-1230 polyalkyleneoxide-alkoxysilane, 7.0 wt % chromium fluozirconate, and 10.7 wt % VANQUEST 2010 etidronic acid; in which the inorganic to organic ratio of the composition was 0.52.

6. Treatment composition comprising 65.1 wt % distilled water, 6.3 wt % MOMENTIVE WETLINK 78 3-glycidoxypropylmethyldiethoxysilane, 7.0 wt % chromium fluozirconate, 10.9 wt % ACUMER 1510 polyacrylic acid, and 10.7 wt % VANQUEST 2010 etidronic acid; in which the inorganic to organic ratio of the composition was 0.40.

7. Treatment composition comprising 67.7 wt % distilled water, 5.6 wt % chromium fluozirconate, and 26.6 wt % ACUMER 1510 polyacrylic acid; in which the inorganic to organic ratio of the composition was 0.89.

8. Treatment composition comprising 56.7 wt % distilled water, 6.3 wt % Silquest-A1100 aminopropyltriethoxy silane, 5.6 wt % chromium fluozirconate, 13.4 wt % Gantrez S-97 BF methylvinylether/maleic acid copolymer, and 13.2 wt % VANQUEST 2010 etidronic acid; in which the inorganic to organic ratio of the composition was 0.48.

9. Treatment composition comprising 63.7 wt % distilled water, 5.4 wt % Silquest-A1100 aminopropyltriethoxy silane, 7.9 wt % chromium fluozirconate, 11.6 wt % ACUMER 1510 polyacrylic acid, and 11.4 wt % VANQUEST 2010 etidronic acid; in which the inorganic to organic ratio of the composition was 0.62.

10. Treatment composition comprising 66.7 wt % distilled water, 4.4 wt % Silquest-A1100 aminopropyltriethoxy silane, 10.3 wt % chromium fluozirconate, 9.4 wt % ACUMER 1510 polyacrylic acid, and 9.2 wt % VANQUEST 2010 etidronic acid; in which the inorganic to organic ratio of the composition was 1.00.

TABLE 5

Test Results of Various Treatment Compositions

| Treatment Composition Formula | Stability | Neutral Salt Spray (Hrs to Appearance of Corrosion or Rust) | Stack Testing (% of White Rust at Given Time Interval) | QCT (Hrs to Appearance of Corrosion or Rust) |
|---|---|---|---|---|
| 1 | PASS | 48, 48 | 5%, 5% (360 hrs) | 360 |
| 2 | PASS | 96, 168 | 5%, 10% (360 hrs) | 480 |
| 3 | PASS | 96, 336 | 5%, 5% (96 hrs) | 480 |
| 4 | PASS | 120, 408 | <5%, <5% (96 hrs) | 480 |
| 5 | PASS | 264, 264 | <5%, 5% (96 hrs) | 480 |
| 6 | PASS | 288, 288 | <5%, <5% (96 hrs) | 480 |
| 7 | PASS | 24, 24 | <5%, <5% (96 hrs) | 480 |
| 8 | PASS | 168 | <5%, <5% (360 hrs) | 480 |
| 9 | PASS | 216 | <5%, <5% (360 hrs) | 480 |
| 10 | PASS | 168, 264 | 5%, 5% (360 hrs) | 480 |

As can be seen in the results summarized in Table 5 above, various treatment compositions containing an organopolyphosphonic acid or salt thereof, an organosilane, and a trivalent chromium compound were found to be effective in the passivation and pretreatment of zinc-containing metal surfaces. The epoxy-functional alkoxysilane and ethoxysilane used in formulas 5 and 6, respectively, showed especially enhanced resistance to corrosion and rust. The tests also showed that while an agent for reducing the hydrophilicity of the coated metal surface, such as a polyacrylic acid, could be optionally used in a treatment composition containing an organopolyphosphonic acid or salt thereof, an organosilane, and a trivalent chromium compound, the use of such agents without a silane showed weaker results under Neutral Salt Spray testing. This is shown in Table 5 above by treatment composition formula 7, which comprised distilled water, chromium fluozirconate, and ACUMER 1510 polyacrylic acid.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed is:

1. A process for treating a surface of a zinc-containing metal, said process comprising contacting the metal surface with an aqueous composition comprising an organopolyphosphonic acid or salt thereof, an polyalkyleneoxidealkoxysilane, and a trivalent chromium compound.

2. The process of claim 1, wherein the organopolyphosphonic acid or salt thereof is a bisphosphonic acid or salt thereof.

3. The process of claim 1, wherein the organopolyphosphonic acid or salt thereof is etidronic acid.

4. The process of claim 1, wherein the trivalent chromium compound is selected from the group consisting of a chromium (III) trifluoride, a chromium (III) nitrate, a chromium (III) gluconate, and a chromium (III) fluozirconate.

5. The process of claim 4, wherein the trivalent chromium compound is chromium (III) fluozirconate.

6. The process of claim 1, wherein the organopolyphosphonic acid or salt thereof is a bisphosphonic acid or salt thereof and the trivalent chromium compound is selected from the group consisting of a chromium (III) trifluoride, a chromium (III) nitrate, a chromium (III) gluconate, and a chromium (III) fluozirconate.

7. The process of claim 6, wherein the bisphosphonic acid or salt thereof is etidronic acid.

8. The process of claim 6, wherein the trivalent chromium compound is chromium (III) fluozirconate.

9. A process for treating a surface of a zinc-containing metal, said process comprising the steps of:

cleaning the metal surface to form a cleaned metal surface;

rinsing the cleaned metal surface with water to form a rinsed metal surface; and contacting the rinsed metal surface with an aqueous composition comprising an organopolyphosphonic acid or salt thereof, polyalkyleneoxidealkoxysilane, and a trivalent chromium compound.

10. The process of claim 9 further comprising, after the contacting step:

rinsing the metal surface with water; and then painting the surface of the metal.

11. A process for treating a surface of a zinc-containing metal, the process comprising contacting the metal surface with an aqueous composition comprising etidronic acid, polyalkyleneoxidealkoxysilane, and chromium (III) fluozirconate.

* * * * *